US008128067B2

(12) United States Patent
Terry et al.

(10) Patent No.: US 8,128,067 B2
(45) Date of Patent: Mar. 6, 2012

(54) DEVICE AND METHOD PROVIDING REDUNDANT AUTOMATIC CLUTCH RELEASE AND ENGINE SHUT DOWN ON A DRILLING OR PRODUCTION RIG

(76) Inventors: William A. Terry, Bakersfield, CA (US); Jerrie L. Terry, Bakersfield, CA (US)

( * ) Notice: Subject to any disclaimer, the term of this patent is extended or adjusted under 35 U.S.C. 154(b) by 599 days.

(21) Appl. No.: 12/335,298

(22) Filed: Dec. 15, 2008

(65) Prior Publication Data

US 2010/0147588 A1 Jun. 17, 2010

(51) Int. Cl.
*B66D 1/60* (2006.01)

(52) U.S. Cl. ..... 254/274; 254/273

(58) Field of Classification Search ..... 254/270, 254/271, 272, 273, 274, 275; 175/24, 27, 175/40

See application file for complete search history.

(56) References Cited

U.S. PATENT DOCUMENTS

| | | | | |
|---|---|---|---|---|
| 3,076,966 | A | 2/1963 | Suter et al. | |
| 3,677,520 | A | 7/1972 | Koomey | |
| 3,843,096 | A * | 10/1974 | Wilson et al. | 254/270 |
| 4,284,253 | A | 8/1981 | Uribe | |
| 4,591,131 | A * | 5/1986 | Rhoads | 254/269 |
| 4,875,530 | A * | 10/1989 | Frink et al. | 175/27 |
| 7,114,577 | B2 * | 10/2006 | Newman | 175/27 |

* cited by examiner

*Primary Examiner* — Emmanuel M Marcelo
(74) *Attorney, Agent, or Firm* — Donn K. Harms

(57) ABSTRACT

A drilling rig control system adapted for easy interface between a compressed air supply and a drilling rig clutch and brake. Both manual and automatic controls are provided to initiate the device to interrupt and vent the compressed air supply to the clutch and concurrently communicate compressed air to the brake to cause it to engage the drum winding the cable for the rig. Over-pull sensors monitor cable tension and initiate valves in the control system to initiate the compressed air interruption and rerouting upon any sense of over-pull.

19 Claims, 2 Drawing Sheets

DEVICE AND METHOD PROVIDING REDUNDANT AUTOMATIC CLUTCH RELEASE AND ENGINE SHUT DOWN ON A DRILLING OR PRODUCTION RIG

FIELD OF THE INVENTION

This invention relates to drilling derricks of the type used to drill oil and gas wells and especially relates to an improved automatic air clutch release system to prevent over-travel of the traveling block toward the top of the derrick.

BACKGROUND OF THE INVENTION

It is common practice to employ a drilling derrick when drilling wells into the earth during the search and extraction of oil and gas. Such drilling derricks or rigs may be anywhere from twenty feet tall to over one hundred feet in height.

Conventionally, in such a drilling operation, the derrick will employ what is called a crown block which is rotationally engaged at the top of the derrick. The crown block employs one or more sheaves over which a cable is threaded. The crown block and cable support a traveling block which is suspended by the cable below the crown block. A first end of the cable extending from the crown block is connected to a drum which rotates under power inside of a drawworks. The drum is generally engaged to a source of power such as an engine or motor using a clutch when in a powered state and to a brake to prevent rotation when the drum is not in a powered state. The other end of the cable is called a deadline and is connected through a deadline anchor to a storage reel which allows the inclusion of more cable to the system.

During operation of the derrick, the drum when powered operates to reel and unreel the cable around the crown block thereby translating the traveling block, and any load engaged thereto, upward toward the crown block and back toward the ground depending on the rotation direction of the drum. When engaged to the drilling pipe, the segment length of the pipe will generally determine the length of travel of the traveling block toward the crown block. Exceeding this travel slightly is only an occurrence allowed when a longer length segment is engaged, or a segment with a collar or the like. It is important that the traveling block not contact the top of the derrick or the crown block during operation of the equipment or serious damage to the equipment can result. Injuries to workers below are a constant threat from such an impact. Consequently, an automatic shutoff with an override to allow for slightly longer segments is preferable.

Further, the weight or load of the mass of the pipe in the bore, can be extreme and easily cause an over-pull on the cable and rig. Over-speed movement of the mass and the resulting force from the mass acceleration, can also cause an over-pull and seriously damage the equipment by exceeding the strength of the components and breaking them. Additionally, the weight alone of the assembled pipe segments can be cause for concern if it is approaching system over-pull limits.

Still further, contact by the crown block and traveling block, sufficient to damage the equipment and cabling, will concurrently cause a loss of engagement to the load being hoisted, allowing it to fall. Such falling pipe, cable, traveling block, and equipment components will generally cause serious injuries or untimely death to workers below if allowed to occur.

It is consequently extremely important that the worker operating the drawworks continually exercise extreme care in how far the traveling block is allowed to translate toward the crown block. Most workers in this highly competitive environment work long tiring hours which can eventually cause loss in their concentration ability while at their post. A momentary lapse in judgement or attention with regard to the rig however, can have life threatening consequences. Further, it can be especially hard to judge the distance of the traveling block from contact with the crown block in cases where the derrick is very tall, at night, and in poor lighting conditions such as at sunset or sunrise.

Additionally, it is also important that the force of the mass of the load being hoisted be constantly monitored in this environment since workers are unable to mentally calculate such loads. Excess speed, or excess weight even at normal speeds, can easily develop a force on the equipment exceeding cable and equipment limits which as noted can also cause collapse of the system or suspended equipment upon workers and damaged drilling rigs.

U.S. Pat. No. 3,677,520 (Koomey) teaches a device for preventing the traveling block of a drilling rig from being drawn into the top of the rig by the employment of a toggle valve engaging the cable on the cable drum to control the rig brake and rig clutch. A manual safety override is provided to allow for longer lengths of drill pipe or drill collars or other special tools to be handled instead of a set length of pipe. Koomey, however, is a mechanically operated system engaged to the drawworks and requires that the cable hit a trip switch which cuts off air communicated to the drum clutch and vents it to the brake. It is thus susceptible to mechanical failure.

U.S. Pat. No. 4,284,253 (Uribe) improves on the system of Koomey. In combination with the mechanically operated system similar to Koomey, Uribe provides an emergency cutoff switch allowing anyone to manually initiate the clutch release and braking of the drum during operation.

Consequently, there is an unmet need for a system that is easily interfaced with the rig operating components and monitors a plurality of hazards to equipment and workers automatically. So interfaced and operatively engaged, such a system should initiate an automatic cessation of operation prior to rig damage and exposing workers to potential injury. Such a system should concurrently monitor traveling block height as well as the load on the system from the assembled pipe segments and other components contributing to the mass being hoisted or lowered. Such a device, in addition to providing a worker-activated emergency cut off, should interface with rig airlines and electrical components to automatically stop the hoist system if the force of the load being hoisted exceeds a predetermined system maximum load.

With respect to the above, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing other automatically operated multiple component monitoring systems for drilling rigs and the like, for carrying out the several purposes of the present disclosed device. It is important, therefore, that the objects and claims be regarded as including such equivalent construction and methodology insofar as they do not depart from the spirit and scope of the present invention.

SUMMARY OF THE INVENTION

The device herein disclosed and described is easily engaged and interfaced with conventional drilling rig components. The device provides a manual and automatic means for cessation of drum rotation in a rotary rig hoisting system to thereby cease travel of the traveling block toward the crown block atop the derrick. Activation of the system to initiate a cessation of drum rotation is provided by a manual switch engaged to its housing or operatively engaged to the system in the housing. A plurality of rig operation monitoring devices are then capable of causing the device to disconnect the motor-engaged clutch from the drum and initiate a brake to contact and cease drum rotation.

The manual activation of the device is provided through input initiated by a user such as a rig worker closing a switch to activate the system. The device being interfaced with the hydraulic and electrical systems of the drilling rig, initiates actions to cease drum rotation. Closing the manual emergency switch can be with a button or other mechanical switch, or, may be activated by a computer input from a remote location monitoring the derrick operation.

Automatic activation is provided from a plurality of sensor components also operatively interfaced with the device. Signals from the sensors provide a means to continuously monitor the hoist system functions and the translation of the traveling block toward the crown. Using electrical signals from these monitoring components, the device will automatically operate to cease drum rotation and hoist travel.

The device is interfaced with sensors adapted to continually ascertain cable loading to guard against over stress of the cable and components by the mass of the load being hoisted developing a force exceeding system limits. A first load sensor is engaged to the deadline of the rig to monitor cable loading. In a manner such as that taught by U.S. Pat. No. 3,076,966 (incorporated herein by reference) the load sensor generates a hydraulic pressure relative to the total load affecting cable tension and corrected for mechanical advantage of the rig. This hydraulic signal is based on communicated through a sealed conduit and varies relative to the amount of the fluid and pressure moving through the conduit. Fluid movement and hydraulic pressure are developed by a diaphragm which is mechanically engaged to the deadline of the hoisting system. Increases in the communicated fluid and pressure in the conduit are directly proportional to any increases in cable tension caused by the load. This hydraulic signal is communicated through the sealed conduit operatively engaged to the device and to a diaphragm engaged to a rotating arm which moves back and forth relative to fluid moving through the conduit under pressure. Movement of the rotating arm to a position close to a proximity sensor housed in the device and operatively mounted next to the arm will cause a circuit to be closed or opened as needed to thereby generate and communicate an electrical signal to one or a plurality of operative electrical means for switching such as relays of the disclosed device. Energizing these relays will cause immediate changes in the rig's functions.

A maximum movement of fluid under pressure in the line therefor can be ascertained relative to the maximum load for the hoisting system and corrected for mechanical advantage of the rig. If this maximum load is approached or exceeded, it will cause a switching at the other end of the conduit communicating with the diaphragm within the device. This switching action is caused by movement of the arm due to the communicated pressurized fluid in the conduit. Movement to a predetermined point by the arm will trip the proximity sensor switch. This first load-generated switching signal, according to the method and device herein disclosed will cause immediate disconnection of the drum clutch from the engine powering the drum and a concurrent application of a drum brake. These concurrent interruptive actions thereby initiate a cessation of the derrick's operation prior to damage or injuries occurring from overloading the hoist.

The device is also operatively engaged with a second means to ascertain the stress of a load on the hoist system. This second cable load sensing is provided by a means to electronically monitor cable tension on the dead line portion of the cable. This monitoring is accomplished by employing a millivolt load cell, operatively engaged with the dead line, which generates an electrical signal relative to the current load on the dead line cable.

The voltage communicated from the load cell to the operatively engaged device herein, is directly proportional to the load on the hoist system creating a tension force on the dead line. Using the communicated electrical signal based on voltage or other electrical signals from the load cell, norms can be developed to ascertain a scale of safe operation of the hoist system based on the voltage or other signal communicated from the load cell. Should the voltage from the load cell exceed this pre set maximum, a computer or software-based computerized operation will cause the hoist system to disconnect the clutch engaging the drum to the engine, and, to concurrently engage the brake to stop the drum from rotating and translating the load before damage is done.

In operation, either an intentional mechanical activation by a worker, or the first load switching signal from the diaphragm, or the second load sensing signal from the millivolt load cell, or a remotely generated computer or manual signal, will cause a plurality of solenoid-activated or switch-activated air valves, to cease air pressure engaging the clutch to the drum, and to concurrently communicate air pressure to a pneumatically operated drum brake to slow and stop rotation of the drum prior to damage occurring. Once initiated by any of the manual or automatic inputs to the operatively engaged device, the device operates to immediately cease movement of the traveling block, toward or away from the crown block through the cessation of power from the engine through the clutch to rotate the drum, and, the immediate frictional engagement of the pneumatic brake to the drum.

It is thus an object of the invention to provide a device for the safe operation of a drilling rig hoisting system which acts to cease movement of the traveling block should an over-pull on the system be detected.

In addition, it is an object of this invention, to provide a drilling rig safety device which upon sensing an over-pull problem concurrently removes power from the drum and applies the brake irrespective of the actions of the rig operator.

An additional object of this invention, is the provision of such a device, with a plurality of operational safety functions, which may easily be interfaced with sensors, power, and hydraulic of a conventional drilling rig.

Another object of this invention is to provide such a device which enables such cessation using either a manual, a computer generated, or a sensor-generated cessation signal.

A further object of this invention is to provide such a device that when interfaced with the rig, monitors a plurality of concurrent load monitoring signals from a plurality of means to monitor the load on the cables, to thereby guard against a failure by a single such monitoring device leading to failure of the entire system.

These together with other objects and advantages which will become subsequently apparent reside in the details of the construction and method as more fully hereinafter described and claimed, reference being had to the accompanying drawings forming a part thereof, wherein like numerals refer to like parts throughout.

With respect to the above summary of the invention and background, before explaining at least one preferred embodiment of the invention in detail, it is to be understood that the invention is not limited in its application to the details of construction and to the arrangement of the components and/or steps set forth in the following description or illustrated in the drawings. The various apparatus and methods of the invention herein described and disclosed are capable of other embodiments and of being practiced and carried out in various ways which will be obvious to those skilled in the art once they review this disclosure. Also, it is to be understood that the phraseology and terminology employed herein are for the purpose of description only and should not be regarded as limiting in any manner whatsoever.

As such, those skilled in the art will appreciate that the conception upon which this disclosure is based may readily be utilized as a basis for the designing of other devices, methods and systems for carrying out the several purposes of the present disclosed device and method for monitoring current load conditions on a drilling rig and initiating cessation of drum rotation in the event of a sensed problem. It is important, therefore, that the objects and claims of this invention be regarded as including any such equivalent construction and methodology as would occur to those skilled in the art insofar as they do not depart from the spirit and scope of the present invention.

DETAILED DESCRIPTION OF THE PREFERRED EMBODIMENT

Figure 1:
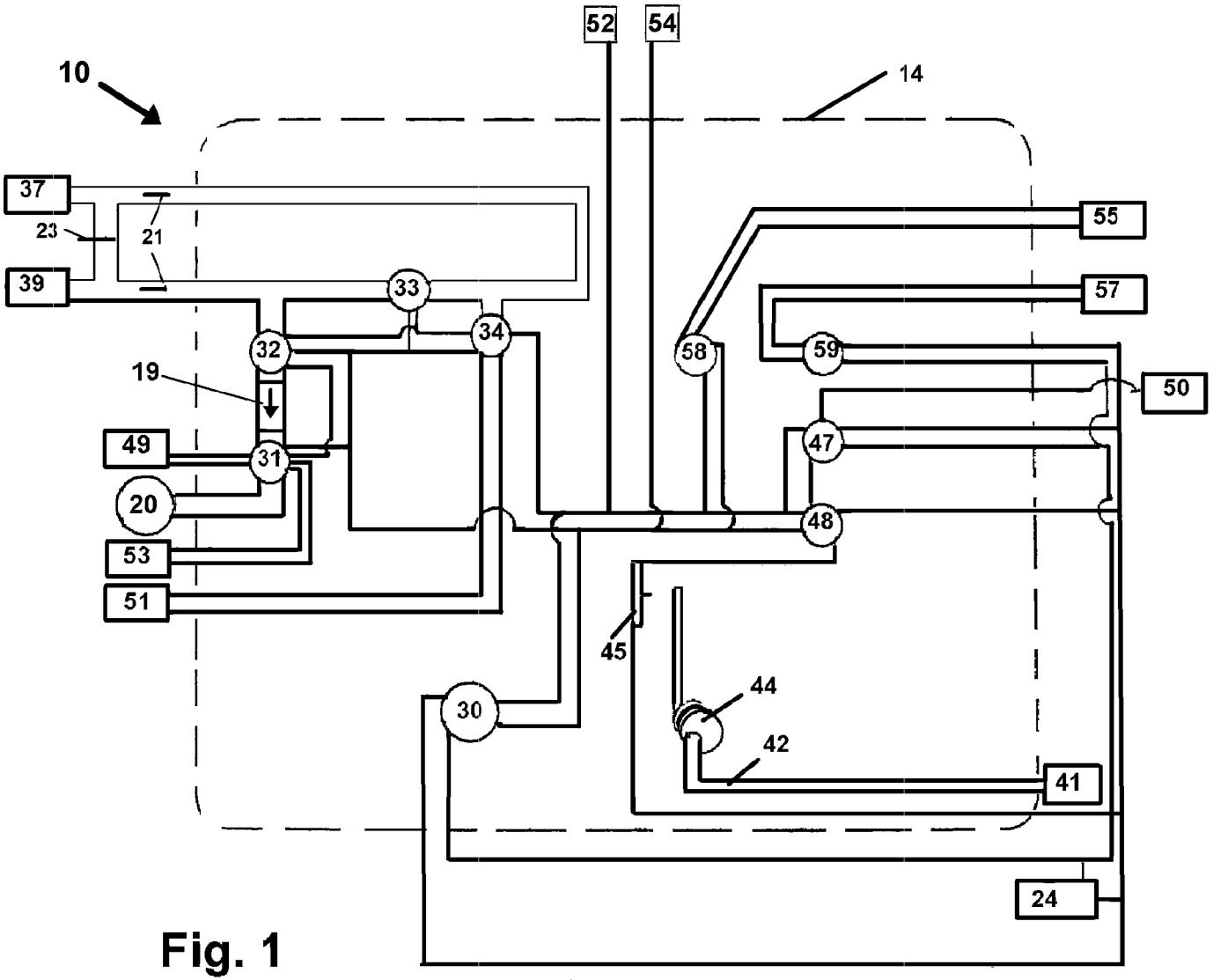
FIG. 1 is a depiction of the device showing the various lines of input signals and resulting communication and operation of components of the device.
Figure 2:
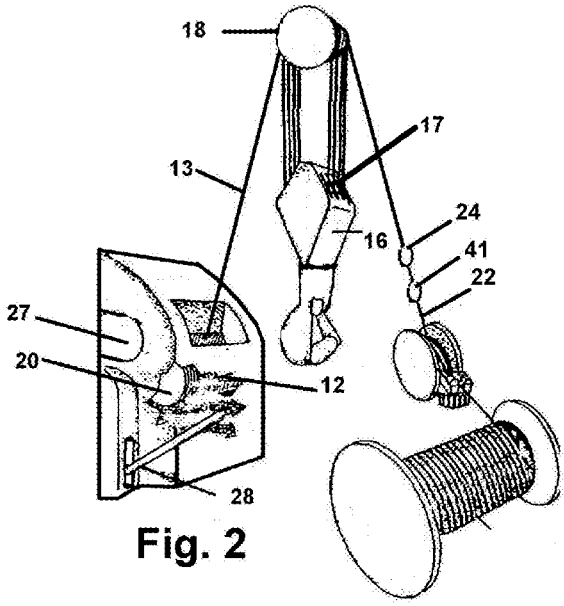
FIG. 2 depicts a simplified depiction of a rotary rig and cable system.
Figure 3:
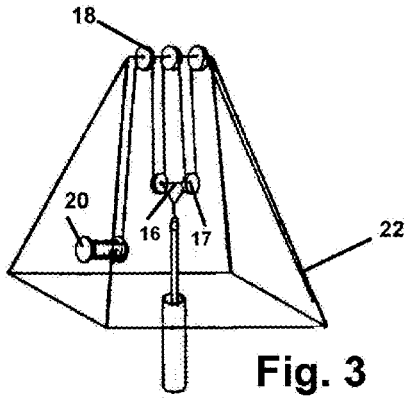
FIG. 3 depicts the load generation on a typical hoisting system of the invention and the division of the load by the number cables and reels.

Referring now to the drawings, FIGS. 1-3 where similar components are identified in one or more of the drawings with the same numerals, the device 10 herein disclosed interfaces with conventional drilling rig electrical and hydraulic systems. Using a plurality of automatic rig sensors, and switching means such as relays, the device 10 when operatively engaged serves to initiate an automatic cessation of rotation of the cable drum 12 on a rotary rig hoisting system as a means to cease vertical travel of the traveling block 16 toward or away from the crown block 18 which is conventionally rotationally engaged atop the supporting derrick. The components of the device 10 as depicted in FIG. 1 would preferably be encased in a housing 14 providing protection to the various electrical components and wiring and air conduits inside the housing 14 during rig drilling operations. Conduits and electrical connections would communicate with the exterior of the housing 14 so they may be engaged to appropriate wiring and hydraulic components of a conventional drilling rig. Those skilled in the art will realize that a large body of electrical connectors exist that are adapted to the task of interfacing the device 10 with rig components. Consequently any connecters as would occur to those skilled in the art to act as an interface for the device 10 with various rig components, are anticipated.

Electrical power to the various components of the device 10 is provided by a low voltage input such as a transformer, and wiring operatively connects all the various relays, switches, and sensor components. Those skilled in the art will easily realize there are numerous ways to wire the internal components of the device 10 together to communicate electrically and to communicate electrical power to operate the components. All such wiring schemes as would occur to those skilled in the art are anticipated by this application.

Cable hoist systems employed in drilling rig installations are well known and depicted graphically in FIG. 2. In such drilling rig operations the load on the cable 13 is divided by the number of reels 17 and cable 13 loops such that the actual load at the dead line 22 is a multiple of the number of loops and reels 17. This would of course be taken into consideration in the operation of the device 10 in both software and computation of electronic and hydraulic sensor readings.

A first means to cease travel block 16 movement is provided by a manual activation input component such as a brake lever 28 which provides a manual means to activate cessation of vertical movement of the traveling block 16. Those skilled in the art will realize that the manually activated component can also be a button or other mechanical switch, or, may be activated by a computer 27 input from a remote location visually monitoring the derrick operation. The over riding factor being a manual input component to immediately cease drum 12 rotation by application of a brake 28 and concurrent disconnection of the motor, hydraulicly powered pump, or other means to rotate the drum 12 is provided. The brake lever 28 can be activated by a user based on their observation of derrick operations.

The device 10 operates upon sensing an over-pull or other problems, to concurrently provide a means to cease traveling block 16 movement in a number of ways. It provides both a manually activated switch 30 to cease travel of the block 16 as well as automated cessation of block 16 travel using a plurality of load sensing components which monitor the load on the cable 13 supporting the load being hoisted or lowered by the derrick.

A first such automatic cessation of traveling block 16 movement is provided by monitoring a signal from a load sensing means which continuously monitors the cable tension at the dead line 22. The signal is provided by an electronic cable tension sensor 24 engaged to the cable in a manner to constantly ascertain cable 13 tension at the dead line 22 at all times during operation of the derrick. This electronic cable tension sensor 24, such as a millivolt load cell, generates and transmits an electrical signal relative to a cable load, such as a range of voltages. The electrical signal so generated is directly proportional to the actual load upon the dead line cable 22 portion, communicated to it by the load cable 13.

The device 10 operates in a first automatic shutdown mode, employing this electrical signal generated from the electronic cable tension sensor 24 such as a millivolt load cell. The signal so generated may be communicated to a microprocessor having software adapted to ascertain the total load on the load cable 13, based on the electronic signal so communicated from the tension sensor 24. The software running on the microprocessor, based on the input electrical signal from the cable tension sensor 24, and using preprogrammed load cable 13 limits, then generates an electrical signal 50 if limits are determined to be exceeded or approaching the upper limit. Of course the electrical signal 50 can also just be directly communicated to the operatively engaged device 10 and the device 10 attenuated for the relative load to signal communicated, or the cable tension sensor 24 may have onboard means to adjust the signal 50 to match the cable 13 load limits depending on the number of reels and loops of the cable 13.

The device 10 receives the electrical signal 50 and if it indicates a load past a given threshold, a relay 47 or switch is activated to energize and electrically activate a number of components of the device 10. Activation of the relay 47 moves the device 10 to an activated state and energizes the clutch air valve 33, the clutch air diverter valve 32, the clutch air bleed valve 34, and the brake air valve 31, to individual respective activated states. Also provided are manually activated valves 21 and 23 allowing the user to manually initiate a bypass.

A manual activation is also provided with a switch 30 communicating with the exterior of the housing 14. A rig worker or user, flipping the switch 30 will manually cause a changing of the clutch air valve 33, the clutch air diverter valve 32, the clutch air bleed valve 34, and the brake air valve 31, to individual respective activated states.

During normal operations of the rig, the device 10 allows communication of fluid pressure which as noted is preferably compressed air along a first pathway when the relay 47 or other switch in an inactivated state allows compressed air pressure from compressed air from a compressor through a system conduit starting at the air input 39 and communicating through the device 10, to the clutch control operated by a worker and on to the clutch 37. With the first pathway operational and device 10 interfaced with the rig components, activating the clutch control handle will cause a communication of compressed air pressure from a compressor, through air input 39 of the device 10, and back out to the clutch 37. This causes the clutch to engage to the drum 12 and communicate power to it for rotation. However, should a problem be sensed by a worker activating the switch 30, or by the monitoring sensing devices communicating with the device 10, or by a remote worker viewing rig operations, or by a remote computer 27 monitoring rig operations, the device 10 moves to an activated state to provide for an immediate cessation of operations. Compressed air pressure is then directed by the changing of position of a plurality of valves to redirect compressed air pressure to a second pathway and to vent portions of the first formed pathway of pressure.

In a manual activation to redirect and bleed compressed air pressure, should a worker sense a problem, the switch 30 can be flipped. Changing of the switch will cause closure of the normally open electrically operated clutch air valve 33, moving it to an activated position. In the activated position the air valve 33 ceases the supply of compressed air to the clutch 37 operatively engaged to the device 10. Concurrently, this activation causes the normally closed bleed valve 34 to activate and to immediately open to thereby bleed off remaining compressed air pressure in the system conduit to the clutch 37, through the clutch bleed vent 51 communicating with the exterior of the housing 14. This venting serves to drop line pressure and cause an immediate release of the clutch 37 from the drum 12.

Additionally, activation of the switch 30 moving the device 10 to the activated state and concurrently energizing the normally closed clutch air diverter valve 32 to an activated state and to open and communicate compressed air pressure through the brake air supply valve 31 to the brake 20 along the second pathway formed by the plurality of different valves moving in their position. The brake air supply valve 31 is normally closed when the device is inactivated, preventing compressed air pressure communication to the brake 20 through the device 10. However, the compressed air pressure may be provided directly to the brake 20 without running through the device 10 and the compressed air pressure provided from the second pathway employed to supplement it.

With the clutch air valve 33 blocking the incoming compressed air pressure to the clutch 37, and the clutch air diverter valve 32 and the brake air supply valve 31 both in an activated state with the system, compressed air pressure such as compressed air from the air input 39 to the device 10 is rerouted from the system conduit. This diversion communicates the compressed air pressure through the one-way or check valve 19 to the output conduit operatively connected to the system conduit of the device 10 which normally communicates compressed air pressure to the brake 20. The check valve 19 in-between the diverter valve 32 and the brake air supply valve 31, insures that compressed air pressure from the compressed air only travels in one direction from clutch air diverter valve 32 toward the brake air supply valve 31. This action of rerouting the compressed air pressure from the air input 39 through the device and directly to the brake 20, activates the brake 20 to contact the drum 12 thereby stopping rotation of the drum 12 quickly.

Once the detected problem with the rig is fixed, the system may be changed to the normal state and reinstate the flow along with first pathway. To that end the clutch air valve 33, the air diverter valve 32, and the brake air supply valve 31, all reverse position to their normal configuration from the activated configuration where they form the second pathway and bleed the pressure. Any residual compressed air pressure from compressed air in the line communicating from the device 10 to the brake 20, concurrently is bled to a vent through brake bleed lines 53 which is placed in communication with the output from the device communicating compressed air pressure to the brake 20, by the reversal of brake air supply valve 31 to the inactivated position. In the inactivated position, compressed air pressure input 49 communicates compressed air pressure such as compressed air from the compressor engaged to the input 49 and to the brake 20 when the operator of the rig employs a braking control. In the activated state, the device 10 overrides that supply with the aforementioned rerouting of compressed air pressure from the system conduit supplying the clutch 37 to the brake 20. Or, it might just supplement the compressed air pressure supply to the brake 20 and allow both the operator and the device 10 to activate the brake 20.

The device 10 as noted above, when operatively engaged with the rig electrical and compressed air pressure supply lines, provides an automatic means to stop rotation of the drum 12 to thereby cease block 16 travel. This is done in one, or preferably a plurality of manners.

A first such automatic operation is provided using a hydraulic signal from a sensor adapted to generate a hydraulic pressure in a conduit relative to the load being imparted to the cable 13. Currently, the pressure signal communicated to the device 10 is generated with a diaphragm 41 operatively engaged to the dead line 22. So engaged the diaphragm 41 produces hydraulic pressure in the conduit 42 communicated and in sealed engagement with the device 10. This hydraulic signal serves to rotate lever 44 toward and away from activation component 45. Upon sufficient travel toward and proximate to the activation component 45, or contact with it, depending on whether the activation component 45 is a proximity sensor or manually activated switch, the activation component 45 is closed.

Closure of the activation component 45 communicates an electrical signal to a relay 48 to change to an activated state and thereby close the clutch air valve 33, ceasing compressed air to the clutch 37 and opening the bleed valve 34 to immediately bleed off remaining pressure in the line supplying the clutch 37. As in the manual activation with the switch 30, with the clutch air valve 33 blocking the incoming compressed air to the clutch 37, and the clutch air diverter valve 32 and the brake air supply valve 31 both activated and open, compressed air from the air input 39 to the device 10 is rerouted. This air diversion communicates the compressed air through the check valve 19 to the conduit operatively connected to the device 10 which leads to the brake 20. Concurrently, the check valve 19 in-between the air diverter valve 32 and the brake air supply valve 31, insure that the compressed air only travels in one direction from clutch air diverter valve 32 toward brake air supply valve 31. Again, as in the manual activation, this action of rerouting the compressed air supply from the air input 39 through the device and directly to the brake 20, activates the brake 20 to contact the drum 12 thereby stopping rotation of the drum 12.

In another automatic means to initiate cessation of travel of the block 16, a computer 27 can provide the input signal 50. Using a computer network and software adapted to the task, the computer 27 monitors one or a plurality of rig operations from sensors. The computer generated input signal 50 is in electronic communication with the second relay 47 to change it from a static or inactive state to an activated state. The interfaced computer 27 and software thereby provide an electronic means to monitor a plurality of rig operations for a safe shutdown. The networked computer 27 also allows for remote monitoring of rig operations, and other computer inputs over a network, to move the second relay 47 to an activated state. Moving the second relay 47 to the activated state, communicates an electrical signal and in the same fashion as noted above, reroutes the compressed air supply from the air input 39, directly to the brake 20 and activates the brake 20 to contact the drum 12 and to aid in immediately stopping rotation of the drum 12 quickly.

Thus the computer 27 and software adapted to the task, can monitor any number of rig operations with appropriate sensors engaged and communicating with the computer 27, and initiate the device 10 to thereby cause application of the brake 20 and cessation of power form the engine to the drum 12 by disconnecting the clutch.

During normal operations of the rig, a status relay 59 or sensor, remains in an inactive state thereby allowing an electrical signal to be communicated to a remote position to visually signal normal operations on a remotely located normal status indicator 57 such as a green LED. However, during any activation of the device 10 manually by the switch 30, or automatically as noted above, where components are changed to an activated state to reroute air pressure to apply the brake 20, the status relay 59 is switched to an active state to turn off the remote normal status indicator 57. Concurrently, activation of device 10 to an activated state will also energize an alarm relay 58 or switch and thereby allow communication of an electrical signal to a remote alarm indicator 55 signifying a problem in rig operations. The remote alarm status indicator 55 could be any visually viewable electronically activated device such as a red LED. Once a problem with operation of the rig is rectified and the first relay returned to the inactive state, the alarm relay 58 returns to an inactive state and the status relay 59 returns to an inactive state thereby initiating the normal status indicator 57 at the remote location.

Finally, another mode to cease block travel can be provided and controlled by the device 10 either concurrently with other operations of the device 10 or independently. Conventional diesel engines providing power to rotate the drum 12 of most modern drilling rigs are computer controlled. Thus, a signal may be communicated to the computer controlling the diesel engine to cease and stop providing power to the drum 12.

To that end, communication circuits may be provided from the device 10 to connect to and communicate with the computers running the diesel engine powering the drum 12. As shown in FIG. 1, at any time the device 10 is moved to an activated state by switch 30 or relay 47 through either the manual or automatic activation noted above, an electrical signal can also be communicated over lines 52 and 54 to the computer operating the diesel engine. In the event of sensing of an over-pull by the tension sensor 24 to the computer 27 the computer 27 can initiate the signal concurrently with other noted actions above which will then immediately cease engine operation and thereby safely remove power from the transmission to the drum.

While all of the fundamental characteristics and features of the device and method for automatic clutch release and cessation of drum rotation for a drilling rig have been disclosed with reference to particular embodiments thereof, a latitude of modification, various changes and substitutions are intended in the foregoing disclosure and it will be apparent that in some instances, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined herein.

What is claimed is:

1. A drilling control system for a drilling rig having a crown block and a traveling block, and having a drum receiving power from a motor or engine operatively engaged thereto through a clutch, and having a cable wound on the drum thereby providing translation of the traveling block toward and away from the crown block, and having a drum brake applicable for cessation of drum rotation, said drum brake and said clutch being powered by compressed air pressure communicated a pressure source, said control system having a normal state, and having an activated state ceasing said translation, said control system comprising:

means for switching said control system between said normal state and said activated state;

a system conduit engageable to said pressure source at an input end, said system conduit providing communication of said compressed air pressure through a first pathway to a first output;

said first output adapted for communication of said compressed air pressure to said clutch;

electronic means for flow control of said compressed air pressure along said first pathway;

said electronic means for flow control having a default configuration directing said compressed air pressure to said first output when said control system is switched to said normal state;

said electronic means for flow control having an activated configuration blocking communication of said compressed air pressure between said input of said system conduit and said first output, when said control system is switched to said activated state, thereby dividing said system conduit into a first end communicating with said input, and a second end communicating with said first output;

said electronic means for flow control in said activated configuration causing a bleeding said compressed air pressure said second end of said system conduit to a vent;

said electronic means for flow control in said activated configuration causing a communication of said compressed air flow from said first end of said system conduit, through a second pathway to said second output;

said electronic means for flow control bleeding said compressed air pressure said second pathway to said vent, when said control system is switched from said activated state back to said normal state causing a return of said means for flow control to said default configuration; and whereby, with said means for switching said control system in said normal state said compressed air pressure is communicated to said first output to allow operation of said clutch, and when said means for switching said control system is switched to said activated state, said compressed air pressure is redirected from said first output to said second output to initiate application of said brake to engage said drum, and concurrently said compressed air pressure is bled from said second output providing a means to disengage and prevent said clutch from communicating power from said engine to said drum.

2. The drilling control system of claim 1 wherein said means for switching said control system between said normal state and said activated state is an electronic signal, said electronic signal causing said means for switching said control system to switch said electronic means for flow control between said default configuration and said activated configuration.

3. The drilling control system of claim 2 additionally comprising:

said electronic signal is generated by an activation of a manual switch.

4. The drilling control system of claim 3 additionally comprising:

said electronic means for flow control formed by a plurality of valves;

said valves electrically switchable between a first position providing said default configuration, and a second position providing said activated configuration; and said activation of said manual switch causing said plurality of valves to change between said first position and said second position.

5. The drilling control system of claim 2 additionally comprising:

said electronic means for flow control formed by a plurality of valves;

said valves electrically switchable between a first position providing said default configuration, and a second position providing said activated configuration; and said electronic signal communicated to said means for switching said control system between said normal state and said activated state causing said plurality of valves to change between said first position and said second position.

6. The drilling control system of claim of claim 5 additionally comprising:

said means for switching said control system between said normal state and said activated state being an electrically actuated switch;

said switch having a first position providing a communication of electrical power from a power source to said plurality of valves causing said plurality of valves causing a change from said default configuration to said activated configuration;

said switch having a second position providing a communication of electrical power from said power source to said plurality of valves causing a return of said plurality of valves to said default configuration; and said electronic signal causing said electrically actuated switch to change between said first position and said second position.

7. The drilling control system of claim of claim 6 additionally comprising:

said electronic signal provided being an electronic load signal communicated from an electronic means for sensing an imparted stress load upon said cable by a load engaged to said cable, said electronic means for sensing said stress load causing a generation of said electronic load signal when said stress load exceeds a preset maximum of said stress load.

8. The drilling control system of claim of claim 7 additionally comprising:

said electronic means for sensing said stress load generating an electronic stress signal relative to an amount of said stress load;

a microprocessor in communication with said electronic means for sensing said stress load and receiving said electronic stress signal;

software running on said microprocessor adapted to ascertain when said stress load exceeds said preset maximum; and said microprocessor causing a communication of said electronic load signal to said means for switching said control system between said normal state and said activated state, when said software calculates said stress load exceeds said preset maximum, thereby causing a switching to said activated state.

9. The drilling control system of claim of claim 8 additionally comprising:

a manually actuated switch, said switch when actuated to said second position from said first position also causing a communication of said electronic signal to said means for switching said control system between said normal state and said activated state, thereby causing a switching to said activated state.

10. The drilling control system of claim of claim 9 additionally comprising:

a mechanically actuated switch engaged to an electrical power source on a first terminal and with said electrically actuated switch on a second terminal;

said mechanically actuated switch being open in a first position interrupting a flow of said electrical power to said second terminal;

said mechanically actuated switch being closed in a second position providing a communication of said electrical power to said second terminal to actuate said electrically actuated switch;

a first diaphragm engaged to a rotating cylinder with a sealed conduit;

said first diaphragm operatively engaged with said cable to thereby generate a compression of said first diaphragm caused by a cable tension imparted to said cable from a load being lifted;

said compression generating fluid pressure in said sealed conduit, said fluid pressure causing a rotation of said cylinder;

a member engaged to said cylinder at a first end extending to a distal end;

said distal end of said member positioned to cause a contact with said mechanically actuated switch from said rotation of said cylinder;

said contact causing said mechanically actuated switch to move to said second position; and said rotation of said cylinder being relative to said cable tension.

11. The drilling control system of claim 10 additionally comprising:

means to cause a cessation of operation of said motor or engine when said control system is in said activated state thereby providing a means to disconnect said power from said drum concurrently with said compressed air pressure being redirected from said first output to said second output to initiate said application of said brake and providing said means to disengage and prevent said clutch from communicating power from said engine to said drum.

12. The drilling control system of claim of claim 8 additionally comprising:

a mechanically actuated switch engaged to an electrical power source on a first terminal and with said electrically actuated switch on a second terminal;

said mechanically actuated switch being open in a first position interrupting a flow of said electrical power to said second terminal;

said mechanically actuated switch being closed in a second position providing a communication of said electrical power to said second terminal to actuate said electrically actuated switch;

a first diaphragm engaged to a rotating cylinder with a sealed conduit;

said first diaphragm operatively engaged with said cable to thereby generate a compression of said first diaphragm caused by a cable tension imparted to said cable from a load being lifted;

said compression generating fluid pressure in said sealed conduit, said fluid pressure causing a rotation of said cylinder;

a member engaged to said cylinder at a first end extending to a distal end;

said distal end of said member positioned to cause a contact with said mechanically actuated switch from said rotation of said cylinder;

said contact causing said mechanically actuated switch to move to said second position; and said rotation of said cylinder being relative to said cable tension.

13. The drilling control system of claim 12 additionally comprising:

means to cause a cessation of operation of said motor or engine when said control system is in said activated state thereby providing a means to disconnect said power from said drum concurrently with said compressed air pressure being redirected from said first output to said second output to initiate said application of said brake and providing said means to disengage and prevent said clutch from communicating power from said engine to said drum.

14. The drilling control system of claim of claim 7 additionally comprising:

a mechanically actuated switch engaged to an electrical power source on a first terminal and with said electrically actuated switch on a second terminal;

said mechanically actuated switch being open in a first position interrupting a flow of said electrical power to said second terminal;

said mechanically actuated switch being closed in a second position providing a communication of said electrical power to said second terminal to actuate said electrically actuated switch;

a first diaphragm engaged to a rotating cylinder with a sealed conduit;

said first diaphragm operatively engaged with said cable to thereby generate a compression of said first diaphragm caused by a cable tension imparted to said cable from a load being lifted;

said compression generating fluid pressure in said sealed conduit, said fluid pressure causing a rotation of said cylinder;

a member engaged to said cylinder at a first end extending to a distal end;

said distal end of said member positioned to cause a contact with said mechanically actuated switch from said rotation of said cylinder;

said contact causing said mechanically actuated switch to move to said second position; and said rotation of said cylinder being relative to said cable tension.

15. The drilling control system of claim of claim 6 additionally comprising:

a mechanically actuated switch engaged to an electrical power source on a first terminal and with said electrically actuated switch on a second terminal;

said mechanically actuated switch being open in a first position interrupting a flow of said electrical power to said second terminal;

said mechanically actuated switch being closed in a second position providing a communication of said electrical power to said second terminal to actuate said electrically actuated switch;

a first diaphragm engaged to a rotating cylinder with a sealed conduit;

said first diaphragm operatively engaged with said cable to thereby generate a compression of said first diaphragm caused by a cable tension imparted to said cable from a load being lifted;

said compression generating fluid pressure in said sealed conduit, said fluid pressure causing a rotation of said cylinder;

a member engaged to said cylinder at a first end extending to a distal end;

said distal end of said member positioned to cause a contact with said mechanically actuated switch from said rotation of said cylinder;

said contact causing said mechanically actuated switch to move to said second position; and said rotation of said cylinder being relative to said cable tension.

16. The drilling control system of claim 2 additionally comprising:

means to cause a cessation of operation of said motor or engine when said control system is in said activated state thereby providing a means to disconnect said power from said drum concurrently with said compressed air pressure being redirected from said first output to said second output to initiate said application of said brake and providing said means to disengage and prevent said clutch from communicating power from said engine to said drum.

17. The drilling control system of claim 16 additionally comprising:

a housing, said input and said first output and said second output communicating with an exterior of said housing thereby providing a means to interface said control system with said pressure source, said clutch, and said brake respectively.

18. The drilling control system of claim of claim 16 additionally comprising:

an activated status light, said activated status light illuminated when said control system is in said activated state; and said activated status light located in a remote monitoring position and providing visual means for users in said remote monitoring position to determine said drilling rig is operating in an activated fashion; and a video display in said remote monitoring position, said video display providing a view of rig operation at said rig.

19. The drilling control system of claim of claim 1 additionally comprising:

a normal status light, said normal status light illuminated when said control system is in said normal state; and said normal status light located in a remote monitoring position and providing visual means for users in said remote monitoring position to determine said drilling rig is operating in a normal fashion.

* * * * *